US011003103B2

(12) United States Patent
Kinumatsu et al.

(10) Patent No.: US 11,003,103 B2
(45) Date of Patent: May 11, 2021

(54) TONER

(71) Applicant: CANON KABUSHIKI KAISHA, Tokyo (JP)

(72) Inventors: Tetsuya Kinumatsu, Mishima (JP); Kosuke Fukudome, Tokyo (JP); Takaaki Furui, Tokyo (JP); Koji Nishikawa, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/701,292

(22) Filed: Dec. 3, 2019

(65) Prior Publication Data

US 2020/0183293 A1 Jun. 11, 2020

(30) Foreign Application Priority Data

Dec. 10, 2018 (JP) ..... JP2018-230670

(51) Int. Cl.
*G03G 9/08* (2006.01)
*G03G 9/087* (2006.01)

(52) U.S. Cl.
CPC ..... *G03G 9/08711* (2013.01); *G03G 9/08755* (2013.01); *G03G 9/08797* (2013.01)

(58) Field of Classification Search
CPC ..... G03G 9/08711; G03G 9/08755; G03G 9/08797
USPC ..... 430/109.3, 109.4, 111.4
See application file for complete search history.

(56) References Cited

U.S. PATENT DOCUMENTS

| | | | |
|---|---|---|---|
| 7,273,686 | B2 | 9/2007 | Onuma et al. |
| 7,288,354 | B2 | 10/2007 | Moribe et al. |
| 7,351,509 | B2 | 4/2008 | Moribe et al. |
| 7,422,832 | B2 | 9/2008 | Ogawa et al. |
| 7,582,401 | B2 | 9/2009 | Ogawa et al. |
| 7,745,089 | B2 | 6/2010 | Okubo et al. |
| 8,603,712 | B2 | 12/2013 | Aoki et al. |
| 8,652,728 | B2 | 2/2014 | Mine et al. |
| 8,741,519 | B2 | 7/2014 | Watanabe et al. |
| 8,846,284 | B2 | 9/2014 | Kinumatsu et al. |
| 9,034,549 | B2 | 5/2015 | Shiotari et al. |
| 9,040,216 | B2 | 5/2015 | Fukudome et al. |
| 9,116,448 | B2 | 8/2015 | Terauchi et al. |
| 9,134,637 | B2 | 9/2015 | Hotta et al. |
| 9,141,012 | B2 | 9/2015 | Moribe et al. |
| 9,201,323 | B2 | 12/2015 | Nishikawa et al. |
| 9,261,804 | B2 | 2/2016 | Yamazaki et al. |
| 9,261,806 | B2 | 2/2016 | Moribe et al. |
| 9,285,697 | B2 | 3/2016 | Fukudome et al. |
| 9,309,349 | B2 | 4/2016 | Watanabe et al. |
| 9,341,970 | B2 | 5/2016 | Yoshiba et al. |
| 9,429,860 | B2 | 8/2016 | Kinumatsu et al. |
| 9,470,993 | B2 | 10/2016 | Nishikawa et al. |
| 9,588,450 | B2 | 3/2017 | Tsuda et al. |
| 9,594,323 | B2 | 3/2017 | Fujikawa et al. |
| 9,606,462 | B2 | 3/2017 | Nomura et al. |
| 9,625,844 | B2 | 4/2017 | Kaya et al. |
| 9,658,554 | B2 | 5/2017 | Kinumatsu et al. |
| 9,715,188 | B2 | 7/2017 | Terauchi et al. |
| 9,772,570 | B2 | 9/2017 | Tsuda et al. |
| 9,798,256 | B2 | 10/2017 | Kosaki et al. |
| 9,798,262 | B2 | 10/2017 | Toyoizumi et al. |
| 9,811,016 | B2 | 11/2017 | Aoki et al. |
| 9,823,595 | B2 | 11/2017 | Toyoizumi et al. |
| 9,829,818 | B2 | 11/2017 | Yoshiba et al. |
| 9,857,713 | B2 | 1/2018 | Kosaki et al. |
| 9,869,943 | B2 | 1/2018 | Aoki et al. |
| 9,971,263 | B2 | 5/2018 | Fukudome et al. |
| 10,101,683 | B2 | 10/2018 | Nishikawa et al. |
| 10,197,934 | B2 | 2/2019 | Matsui et al. |
| 10,289,016 | B2 | 5/2019 | Fukudome et al. |
| 10,295,920 | B2 | 5/2019 | Nishikawa et al. |
| 10,295,921 | B2 | 5/2019 | Ohmori et al. |
| 10,303,075 | B2 | 5/2019 | Tanaka et al. |
| 10,409,180 | B2 | 9/2019 | Koji et al. |
| 10,545,420 | B2 | 1/2020 | Kinumatsu et al. |
| 2012/0094229 | A1 | 4/2012 | Mine et al. |
| 2015/0037719 | A1 | 2/2015 | Naka et al. |
| 2015/0125790 | A1 | 5/2015 | Hotta et al. |
| 2015/0220013 | A1 | 8/2015 | Nishikawa et al. |
| 2016/0085167 | A1 | 3/2016 | Yoshihara et al. |
| 2016/0161874 | A1 | 6/2016 | Yamazaki et al. |

(Continued)

FOREIGN PATENT DOCUMENTS

| | | |
|---|---|---|
| EP | 1 967 911 | 9/2008 |
| EP | 2 837 971 | 2/2015 |
| JP | H06-234863 | 8/1994 |

(Continued)

OTHER PUBLICATIONS

U.S. Appl. No. 16/701,260, Koji Nishikawa, filed Dec. 3, 2019.

(Continued)

*Primary Examiner* — Mark A Chapman

(74) *Attorney, Agent, or Firm* — Venable LLP

(57) ABSTRACT

A toner including: a toner particle that includes a binder resin and a crystalline material, wherein the binder resin includes a vinyl resin having an ether structure, and where intensities of secondary ion mass/secondary ion charge number (m/z) of 59, 44, and 135 are denoted by A (ppm), B (ppm), and C (ppm), respectively, in a measurement of the toner by time-of-flight secondary ion mass spectrometry, the intensities at 100 nm from the surface of the toner satisfy the relationships of the following formulas (1) and (2):

$$C/(A+B) \leq 1.00 \quad (1)$$

$$(A+B) \geq 2000 \quad (2).$$

7 Claims, No Drawings

(56) References Cited

U.S. PATENT DOCUMENTS

| | | | |
|---|---|---|---|
| 2017/0307993 | A1 | 10/2017 | Sano et al. |
| 2020/0081361 | A1 | 3/2020 | Yoshiba et al. |

FOREIGN PATENT DOCUMENTS

| | | |
|---|---|---|
| JP | 2002-202628 | 7/2002 |
| JP | 2012-108485 | 6/2012 |
| JP | 2015-184465 | 10/2015 |
| JP | 2016-038459 | 3/2016 |
| JP | 2018-013589 | 1/2018 |
| JP | 2018-036596 | 3/2018 |
| WO | 2013/100182 | 7/2013 |
| WO | 2013/115412 | 8/2013 |

OTHER PUBLICATIONS

U.S. Appl. No. 16/701,412, Kosuke Fukudome, filed Dec. 3, 2019.
U.S. Appl. No. 16/583,945, Kosuke Fukudome, filed Sep. 26, 2019.
U.S. Appl. No. 16/584,346, Tetsuya Kinumatsu, filed Sep. 26, 2019.
U.S. Appl. No. 16/728,082, Yasuhiro Hashimoto, filed Dec. 27, 2019.
U.S. Appl. No. 16/728,115, Shotaro Nomura, filed Dec. 27, 2019.
U.S. Appl. No. 16/728,171, Takaaki Furui, filed Dec. 27, 2019.
U.S. Appl. No. 16/728,179, Koji Nishikawa, filed Dec. 27, 2019.

TONER

BACKGROUND OF THE INVENTION

Field of the Invention

The present invention relates to a toner for use in a recording method using an electrophotographic method, an electrostatic recording method, and a toner jet recording method.

Description of the Related Art

Electrophotographic image forming apparatuses are required to have higher speed, longer life, and better energy saving capability, and in order to cope with these requirements, further improvement of various performances is needed for a toner. In particular, from the viewpoint of speeding up and energy saving, further improvement in low-temperature fixing performance of the toner is required. In addition, it is important that the toner does not change in various transportation environments and usage environments. In particular, transportation and storage under high temperature and high humidity are likely to affect the toner, and it is desired that the heat-resistant storage stability of the toner be high.

Regarding low-temperature fixing, first, it is necessary to realize a state where a binder resin is plasticized at the time of fixing and is easily fused. In particular, there are various means for achieving low-temperature fixing. Generally, it is possible to improve the fixing performance by using a toner designed so that the binder resin easily assumes a plastic state. However, in this method, the resin is soft even not at the time of fixing, and heat-resistant storage stability is problematic.

Japanese Patent Application Publication No. 2018-13589 proposes a toner which is added with a crystalline material to use rapid plasticization of a binder resin and improve low-temperature fixing performance.

Also, it is generally known to increase the softening point of the resin as a means for improving the heat-resistant storage stability. In particular, Japanese Patent Application Publication No. 2015-184465 and Japanese Patent Application Publication No. 2012-108485 propose toners that have improved durability and heat-resistant storage stability as a result of crosslinking the toner.

SUMMARY OF THE INVENTION

However, with the technique described in Japanese Patent Application Publication No. 2018-13589, there is a concern that the crystalline material may be plasticized in a high-temperature and high-humidity environment, flowability may be reduced and blocking may occur due to bleeding out of the crystalline material to the toner surface, and the density may be reduced or density unevenness may occur in the image to be outputted.

The toners described in Japanese Patent Application Publication No. 2015-184465 and Japanese Patent Application Publication No. 2012-108485 have a problem in low-temperature fixing performance because the surface layer of the toner is also cross-linked so that the plasticity does not easily progress during fixing.

Further, from the viewpoint of extending the service life, it is also necessary to increase the durability of the toner.

The toner in a toner cartridge is subjected to strong stress such as rubbing at various locations. As the number of development jobs increases, the number of times the toner receives stress is increased, and the stress manifests itself in the form of cracks in the toner, and embedding and detachment of external additive.

In particular, the detachment of external additive may cause member contamination and also cause degradation of toner flowability and charging performance, and oversupply to the photosensitive drum (regulation defect) is often a problem. Therefore, adhesion of external additive to the toner particle is important.

Japanese Patent Application Publication No. H06-234863 proposes that a solvent capable of plasticizing a toner particle be added to enable the external additive to adhere easily to the toner surface layer. However, in this method, the toner contracts due to the volatilization of the solvent, strains tend to occur, and a problem is still associated with the adhesion of external additive.

The present invention provides a toner that satisfies low-temperature fixing performance, storage stability, and flowability at the same time.

The inventors of the present invention have found that the above problem can be solved by a toner having a specific structure on the surface, and this finding led to the creation of the present invention.

Thus, the present invention provides a toner including: a toner particle that includes a binder resin and a crystalline material, wherein the binder resin includes a vinyl resin having an ether structure, and where intensities of secondary ion mass/secondary ion charge number of 59, 44, and 135 are denoted by A (ppm), B (ppm), and C (ppm), respectively, in a measurement of the toner by time-of-flight secondary ion mass spectrometry, the intensities at 100 nm from a surface of the toner satisfy the relationships of the following formulas (1) and (2)

$$C/(A+B) \leq 1.00 \quad (1)$$

$$(A+B) \geq 2000 \quad (2)$$

According to the present invention, it is possible to provide a toner that satisfies low-temperature fixing performance, storage stability, and flowability at the same time.

Further features of the present invention will become apparent from the following description of exemplary embodiments.

DESCRIPTION OF THE EMBODIMENTS

In the present invention, "from XX to YY" or "XX to YY" representing a numerical range means a numerical range including a lower limit and an upper limit as end points unless otherwise specified.

Also, the monomer unit refers to a form in which a monomer substance in a polymer has reacted.

Hereinafter, embodiments of the present invention are disclosed in more detail, but the present invention is not limited thereto.

The present invention provides a toner having a toner particle including a binder resin and a crystalline material, wherein the binder resin includes a vinyl resin having an ether structure, and where intensities of secondary ion mass/secondary ion charge number (m/z) of 59, 44, and 135 are denoted by A (ppm), B (ppm), and C (ppm), respectively, in a measurement of the toner by time-of-flight secondary ion mass spectrometry, the intensities at 100 nm from a surface of the toner satisfy the relationships of the following formulas (1) and (2)

$$C/(A+B) \leq 1.00 \quad (1)$$

$$(A+B) \geq 2000 \quad (2)$$

Since the toner includes a vinyl resin having an ether structure in the vicinity of the toner particle surface, migration of a release agent and a plasticizer such as crystalline polyester contained inside the toner particle is suppressed. In addition, the toner has excellent low-temperature fixing performance due to the softness of the vinyl resin, and the adhesion of the external additive to the toner particle is not hindered.

A vinyl resin having an ether structure is a polar material, and a release agent and a plasticizer such as a crystalline polyester have a low polarity. Therefore, since the affinity between these materials is low, the plasticizer is prevented from migrating to the toner particle surface even in a high-temperature and high-humidity environment.

However, where a highly polar resin is disposed on the surface of the toner particle, it may affect the low-temperature fixing performance. This is because an increase in the glass transition temperature due to hydrogen bonding between polar groups is considered. As a result, the toner particle surface is unlikely to be plasticized, and the rigidity of the surface is further increased, so that the external additive is unlikely to adhere.

The inventors of the present invention focused their attention on resins having an ether structure among polar resins.

With the ether structure, hydrogen bonds are not formed between the structures, and when a resin is obtained, the resin is very soft, does not inhibit fixing, and enables easy adhesion of external additive.

In the present invention, the binder resin includes a vinyl resin having an ether structure.

Furthermore, intensities of secondary ion mass/secondary ion charge number of 59, 44, and 135 are denoted by A (ppm), B (ppm), and C (ppm), respectively, in a measurement of the toner by time-of-flight secondary ion mass spectrometry, the intensities at 100 nm from the toner surface satisfy the relationships of the following formulas (1) and (2)

$$C/(A+B) \leq 1.00 \quad (1)$$

$$(A+B) \geq 2000 \quad (2)$$

The C/(A+B) is preferably 0.30 or less, and more preferably 0.25 or less. Meanwhile, the lower limit is not particularly limited, and is preferably 0.00 or more, and more preferably 0.01 or more. It is preferable that more ether than the rigid polyester be present in the vicinity of the toner particle surface. The C/(A+B) can be controlled by the addition amount of the vinyl resin having an ether structure or the polyester resin, the amount of ether groups in the compound serving as a precursor of the vinyl resin having an ether structure, and by changing the affinity of the vinyl resin having an ether structure and the medium at the time of production by material selection.

Meanwhile, (A+B) is preferably 2200 ppm or more, and more preferably 2400 ppm or more. Meanwhile, the upper limit is not particularly limited, and is preferably 6000 ppm or less, more preferably 4000 ppm or less. The (A+B) can be controlled by the addition amount of the vinyl resin having an ether structure and the amount of ether groups in the compound serving as a precursor of the vinyl resin having an ether structure.

In the present invention, the relationship between the ion intensity and the secondary ion mass/secondary ion charge number (hereinafter also referred to as m/z) at 100 nm from the surface of the toner is derived using time-of-flight secondary ion mass spectrometry (hereinafter also referred to as TOF-SIMS).

The ratio of the intensity (C; unit ppm) with an (m/z) of 135 to the sum of the intensity (A; unit ppm) with an (m/z) of 59 and the intensity (B; unit ppm) with an (m/z) of 44 is specific for the toner. The sum (A+B) of the intensity with an (m/z) of 59 and the intensity with an (m/z) of 44 is also specific.

The intensity with an (m/z) of 59 means the amount of propylene oxide fragment, and the intensity with an (m/z) of 44 means the amount of ethylene oxide fragment. Moreover, the intensity with an (m/z) of 135 means the amount of fragment derived from bisphenol A.

The formula (1) being in the above range means that the structure derived from ether is present in the vicinity of the toner particle surface in an amount equal to or greater than that of the rigid structure derived from the polyester.

That is, when the formula (1) is satisfied, there is a large amount of polar resin in the vicinity of the toner particle surface. As a result, even under a high-temperature and high-humidity environment, a low-polarity crystalline material is unlikely to migrate to the toner particle surface, a decrease in toner flowability can be prevented, and a decrease in charging characteristics due to storage can also be prevented.

This makes it possible to obtain a good image that is outputted at a density required for image output even in a high-temperature and high-humidity environment and that has no density unevenness.

At the same time, a large amount of resin having an ether structure is present in the vicinity of the toner particle surface, so that an increase in glass transition temperature can be suppressed and a surface with little fixing inhibition can be produced.

When the formula (1) exceeds 1.00, the amount of rigid structural moiety of the polyester increases on the toner particle surface, and fixing inhibition tends to occur. In addition, the polarity of the structural moiety is low, and the migration of a crystalline material such as a release agent is likely to occur. As a result, toner aggregation and toner flowability deterioration may occur, and density unevenness and the like may occur.

Further, (A+B) is 2000 ppm or more.

This indicates that the ether structure is present in a certain amount or more in the vicinity of the toner particle surface. As a result, even under a high-temperature and high-humidity environment, a low-polarity crystalline material is unlikely to migrate to the toner particle surface, a decrease in toner flowability can be prevented and also a decrease in charging characteristics due to storage can be prevented.

This makes it possible to obtain a good image without density unevenness when outputting an image even in a high-temperature and high-humidity environment.

At the same time, a large amount of the resin having an ether structure is present in the vicinity of the toner particle surface, so that an increase in the glass transition temperature can be suppressed and a surface without fixing inhibition can be formed. Furthermore, since a certain amount or more of the resin having an ether structure is present, the vicinity of the toner particle surface is softened, the adhesiveness of the external additive is improved, and an image free of regulation defects can be obtained even in a low-temperature environment.

When (A+B) is less than 2000 ppm, the amount of the ether structure in the vicinity of the toner particle surface is small, and the migration of a crystalline material such as a release agent is likely to occur. As a result, toner aggregation and toner flowability deterioration may occur, and problems such as image density reduction and density unevenness occur, and image quality deteriorates.

The vinyl resin having an ether structure is preferably a resin including, as a constituent component, an alkylene glycol having an unsaturated double bond.

Further, the vinyl resin having an ether structure is preferably a resin having a crosslinked structure.

The cross-linked structure can be introduced by a method using a crystalline polyester having a polymerizable unsaturated group, or by using a polyfunctional monomer shown below, and these may be used in combination.

Where a cross-linked structure is introduced using a polyfunctional monomer, a vinyl polyfunctional monomer is preferable. Examples of the vinyl polyfunctional monomers include polyfunctional monomers of at least one kind selected from the group consisting of bifunctional monomers: polyalkylene glycol diacrylate, 1,6-hexanediol diacrylate, neopentyl glycol diacrylate, polyethylene glycol dimethacrylate, polypropylene glycol dimethacrylate, polytetramethylene glycol dimethacrylate 1,6-hexanediol dimethacrylate, neopentylglycol dimethacrylate, divinylbenzene, divinylnaphthalene, both-end acryl-modified silicone, and both-end methacryl-modified silicone; trifunctional monomers: trimethylolpropane triacrylate and trimethylolpropane trimethacrylate; tetrafunctional monomers: tetramethylol methane tetraacrylate and tetramethylol methane tetramethacrylate.

Of these, bifunctional monomers are preferred.

Especially, it is preferable that the vinyl resin having an ether structure have a monomer unit derived from the crosslinking agent shown by the following structural formula (1).

The amount of the vinyl resin having an ether structure in the binder resin is preferably from 30.0% by mass to 99.0% by mass.

Further, the amount of the monomer unit derived from the crosslinking agent in the vinyl resin having an ether structure is preferably from 0.4% by mass to 3.0% by mass.

From the viewpoint of crosslinking reactivity and flexibility of the crosslinked structure, the molecular weight of the crosslinking agent is preferably from 200 to 2000, and more preferably from 300 to 1500.

(1)

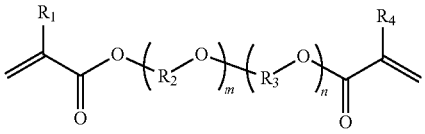

In the structural formula (1), m+n is an integer of 2 or more (preferably an integer of 4 or more, and more preferably an integer of 7 or more, and preferably an integer of 25 or less, and more preferably an integer of 12 or less), $R_1$ and $R_4$ independently represent H or $CH_3$, and $R_2$ and $R_3$ independently represent a hydrocarbon group having a linear or branched chain having from 2 to 12 carbon atoms (preferably from 3 to 8 carbon atoms).

Where the binder resin includes the vinyl resin having a monomer unit derived from the crosslinking agent represented by the structural formula (1), the ether structure derived from the crosslinking agent makes it possible to suppress the migration of the crystalline material to the toner particle surface in a high-temperature and high-humidity environment. As a result, a decrease in flowability can be suppressed.

This makes it possible to obtain a fogging-free satisfactory image when outputting an image even in a high-humidity environment. Further, the presence of a soft resin in the vicinity of the toner particle surface makes it possible to obtain a toner in which fixing inhibition is suppressed. Furthermore, as a result of having a crosslinked structure, it is possible to reduce the decrease in glass transition temperature of the binder resin due to the ether structure, and it is possible to form a flexible crosslinked structure.

As a result, brittleness is reduced, and in a system in which a load is easily applied to the toner, toner cracks are less likely to occur and fogging is suppressed.

Examples of the crosslinking agent satisfying the above structural formula (1) are shown below.

Polyethylene glycol #200 diacrylate (A200), polyethylene glycol #400 diacrylate (A400), polyethylene glycol #600 diacrylate (A600), polyethylene glycol #1000 diacrylate (A1000); and dipropylene glycol diacrylate (APG100), tripropylene glycol diacrylate (APG200), polypropylene glycol #400 diacrylate (APG400), polypropylene glycol #700 diacrylate (APG700), polytetrapropylene glycol #650 diacrylate (A-PTMG-65).

Moreover, it is more preferable that the vinyl resin having an ether structure has a monomer unit derived from a crosslinking agent represented by the following structural formula (2).

(2)

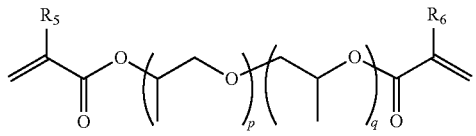

In the structural formula (2), p+q is an integer of 2 or more (preferably an integer of 4 or more, more preferably an integer of 7 or more, and preferably an integer of 12 or less), and $R_5$ and $R_6$ independently represent H or $CH_3$.

Where the binder resin includes a vinyl resin having a monomer unit derived from the crosslinking agent represented by the structural formula (2), the affinity with water can be lowered particularly significantly as compared with other crosslinking agents having an ether structure. As a result, even in an environment where the toner easily adsorbs moisture such as a high-humidity environment, the charging performance is not impaired and the occurrence of fogging can be suppressed.

Further, a large amount of soft structures can be present on the surface of the toner particles, and fixing inhibition can be further suppressed.

In the case of a vinyl resin having an ether structure derived from a crosslinking agent other than the crosslinking agent represented by the structural formula (2), there are two types of crosslinked structures.

In the crosslinking agent represented by the structural formula (1), when $R_2$ and $R_3$ have less than 3 carbon atoms, or when both $R_2$ and $R_3$ are linear propylene, the affinity for water becomes relatively high. As a result, in an environment where the toner tends to adsorb moisture, such as a high-humidity environment, the charging performance is likely to be impaired and fogging is likely to occur.

Meanwhile, in the crosslinking agent represented by the structural formula (1), when $R_2$ and $R_3$ have more than 3 carbon atoms, the amount of carbon with respect to oxygen atoms increases, and the effect of the ether group tends to decrease. As a result, fixing inhibition tends to occur.

Where the intensities of secondary ion mass/secondary ion charge number (m/z) of 59, 44, and 56 is denoted by A (ppm), B (ppm), and D (ppm), respectively, in a measurement of the toner by time-of-flight secondary ion mass spectrometry, the intensities at an outermost surface of the toner preferably satisfy a following formula (3).

$$D \leq (A+B) \quad (3)$$

Here, an intensity with an (m/z) of 56 means the iron fragment amount. Further, (A+B)−D is preferably from 1000 ppm to 4000 ppm.

Here, D≤(A+B) can be controlled by the amount of the magnetic bodies, the amount of the vinyl resin having an ether structure, the amount of the ether group in the compound that is a precursor of the vinyl resin having an ether structure, and by changing the affinity of the vinyl resin having an ether structure and the magnetic bodies for the medium at the time of production by material selection and surface treatment agent selection.

As a result of satisfying the relationship of D≤(A+B), the surface layer has many ether groups, and the durability is further improved.

Further, in the toner, where a toner hardness (N/m) is plotted against an ordinate, a load application speed (μN/sec) is plotted against an abscissa, and a intercept of a straight line connecting a toner hardness A (N/m) and a toner hardness B (N/m) determined by a nanoindentation method is taken as a toner hardness C (N/m) at a point of time at which the load application speed is 0.00 μN/sec, it is preferable that the value of C be 850.0 or less.

The toner hardness A is an average value of a slope in a displacement region of from 0.00 μm to 0.20 μm in a load-displacement curve obtained by measuring the toner under a condition of a load application speed of 0.83 μN/sec where a load (mN) is plotted against the ordinate, and a displacement amount (μm) is plotted against the abscissa; and the toner hardness B is an average value of a slope in a displacement region of from 0.00 μm to 0.20 μm in a load-displacement curve obtained by measuring the toner under a condition of a load application speed of 2.50 μN/sec where a load (mN) is plotted against the ordinate, and a displacement amount (μm) is plotted against the abscissa.

The value C is an index indicating the ease of deformation of the toner in the non-pressurized state.

Where the value of C is 850.0 or less, the surface is soft and the low-temperature fixing performance can be improved. Therefore, it is preferable that this value be 840.0 or less because the low-temperature fixing performance can be further improved. The value of C is more preferably 830.0 or less. Meanwhile, the lower limit is not particularly limited, but is preferably 600.0 or more, and more preferably 650.0 or more. The value of C can be controlled by the amount of amorphous polyester in the surface layer, the amount of crosslinking agent present, and the type of crosslinking agent.

The binder resin is not particularly limited, and a known resin for toner can be used. Specific examples of the binder resin include polyester resin, polyurethane resin, and vinyl resin. In addition, it is preferable that the binder resin include 50% by mass or more of styrene acrylic resin.

Examples of monomers that can be used for producing a vinyl resin include the following monomers.

Aliphatic Vinyl Hydrocarbons:

alkenes such as ethylene, propylene, butene, isobutylene, pentene, heptene, diisobutylene, octene, dodecene, octadecene, and α-olefins other than those described above;

alkadienes such as butadiene, isoprene, 1,4-pentadiene, 1,6-hexadiene and 1,7-octadiene.

Alicyclic vinyl hydrocarbons: mono- or di-cycloalkenes and alkadienes, such as cyclohexene, cyclopentadiene, vinylcyclohexene, and ethylidenebicycloheptene;

terpenes such as pinene, limonene, and indene.

Aromatic Vinyl Hydrocarbons:

styrene and hydrocarbyl (alkyl, cycloalkyl, aralkyl and/or alkenyl) substitutions thereof such as α-methylstyrene, vinyltoluene, 2,4-dimethylstyrene, ethylstyrene, isopropylstyrene, butylstyrene, phenylstyrene, cyclohexylstyrene, benzylstyrene, crotylbenzene, divinylbenzene, divinyltoluene, divinylxylene, trivinylbenzene, and vinylnaphthalene.

Carboxy group-containing vinyl monomers and metal salts thereof:

unsaturated monocarboxylic acid, unsaturated dicarboxylic acid having from 3 to 30 carbon atoms, anhydrides thereof and monoalkyl (from 1 to 27 carbon atoms) esters thereof.

For example, carboxy group-containing vinyl monomers of acrylic acid, methacrylic acid, maleic acid, maleic anhydride, maleic acid monoalkyl esters, fumaric acid, fumaric acid monoalkyl esters, crotonic acid, itaconic acid, itaconic acid monoalkyl esters, itaconic acid glycol monoether, citraconic acid, citraconic acid monoalkyl ester, and cinnamic acid.

Vinyl esters such as vinyl acetate, vinyl butyrate, vinyl propionate, diallyl phthalate, diallyl adipate, isopropenyl acetate, vinyl methacrylate, methyl 4-vinyl benzoate, cyclohexyl methacrylate, benzyl methacrylate, phenyl acrylate, phenyl methacrylate, vinyl methoxyacetate, vinyl benzoate, ethyl ca-ethoxyacrylate, alkyl acrylates and alkyl methacrylates having from 1 to 22 carbon atoms (linear or branched) (methyl acrylate, methyl methacrylate, ethyl acrylate, ethyl methacrylate, propyl acrylate), propyl methacrylate, butyl acrylate, butyl methacrylate, 2-ethylhexyl acrylate, 2-ethylhexyl methacrylate, lauryl acrylate, lauryl methacrylate, myristyl acrylate, myristyl methacrylate, cetyl acrylate, cetyl methacrylate, stearyl acrylate, stearyl methacrylate, eicosyl acrylate, eicosyl methacrylate, behenyl acrylate, behenyl methacrylate, and the like), dialkyl fumarates (dialkyl esters of fumaric acid; the two alkyl groups are linear, branched or alicyclic groups having from 2 to 8 carbon atoms), dialkyl maleates (dialkyl esters of maleic acid; the two alkyl groups are linear, branched or alicyclic groups having from 2 to 8 carbon atoms), polyallyloxyalkanes (diallyloxyethane, triallyloxyethane, tetraallyloxyethane, tetraallyloxypropane, tetraallyloxybutane, tetrametaallyloxyethane), vinyl monomers having a polyalkylene glycol chain (polyethylene glycol (molecular weight 300) monoacrylate, polyethylene glycol (molecular weight 300) monomethacrylate, polypropylene glycol (molecular weight 500) monoacrylate, polypropylene glycol (molecular weight 500) monomethacrylate, methyl alcohol ethylene oxide (ethylene oxide is hereinafter abbreviated as EO) 10 mol adduct acrylate, methyl alcohol ethylene oxide 10 mol adduct methacrylate, lauryl alcohol EO 30 mol adduct acrylate, and lauryl alcohol EO 30 mol adduct methacrylate), polyacrylates and polymethacrylates (polyacrylates and polymethacrylates of polyhydric alcohols: ethylene glycol diacrylate, ethylene glycol dimethacrylate, propylene glycol diacrylate, propylene glycol dimethacrylate, neopentyl glycol diacrylate, neopentyl glycol dimethacrylate, trimethylolpropane triacrylate, trimethylolpropane trimethacrylate, polyethylene glycol diacrylate, and polyethylene glycol dimethacrylate).

Carboxy group-containing vinyl esters:

for example, carboxyalkyl acrylates having an alkyl chain having from 3 to 20 carbon atoms, and carboxyalkyl methacrylates having an alkyl chain having from 3 to 20 carbon atoms.

Of these, styrene, butyl acrylate and the like are preferable.

The binder resin may include a polyester resin, for example, an amorphous polyester resin.

Examples of the monomers that can be used for the production of the amorphous polyester resin include conventionally known divalent, trivalent or higher carboxylic acids and dihydric, trihydric or higher alcohols. Specific examples of these monomers include the following.

As Carboxylic Acids:

divalent carboxylic acids such as oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, phthalic acid, isophthalic acid, terephthalic acid, dodecenyl succinic acid, and the like, anhydrides thereof and lower alkyl esters thereof.

Aliphatic unsaturated dicarboxylic acids such as maleic acid, fumaric acid, itaconic acid, citraconic acid, and the like and lower alkyl esters thereof and anhydrides thereof.

Also, 1,2,4-benzenetricarboxylic acid, 1,2,5-benzenetricarboxylic acid, anhydrides thereof, and lower alkyl esters thereof.

These may be used alone or in combination of two or more.

As Alcohols:

alkylenediols (1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-icosanediol);

alkylene ether glycol (trimethylene glycol, tetramethylene glycol);

alicyclic diols (1,4-cyclohexanedimethanol); bisphenols (bisphenol A); alkylene oxide (ethylene oxide and propylene oxide) adducts of alicyclic diols, alkylene oxide adducts (ethylene oxide and propylene oxide) of bisphenols (bisphenol A).

The alkyl part of alkylene diol and alkylene ether glycol may be linear or branched. In the present invention, branched alkylene diols can also be preferably used.

Further, an aliphatic diol having a double bond can be also used. Examples of the aliphatic diol having a double bond include the following compounds.

2-Butene-1,4-diol, 3-hexene-1,6-diol, and 4-octene-1,8-diol.

Examples of trihydric or higher alcohols include glycerin, trimethylolethane, trimethylolpropane, pentaerythritol and the like.

These may be used alone or in combination of two or more.

For the purpose of adjusting the acid value and hydroxyl value, monovalent acids such as acetic acid and benzoic acid, and monohydric alcohols such as cyclohexanol and benzyl alcohol can be used as necessary.

Of these, amorphous polyesters using bisphenol alcohols are preferred.

For example, it is preferable that the toner particle include an amorphous polyester having a monomer unit represented by the following structural formula (3).

(3)

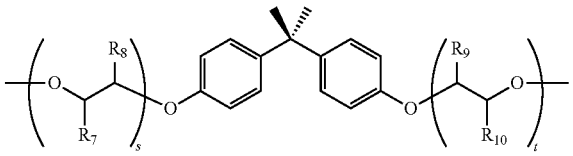

In the structural formula (3), s+t is an integer of 1 or more (preferably an integer of 2 or more, and preferably an integer of 4 or less), and $R_7$, $R_8$, $R_9$, and $R_{10}$ each independently represent H or $CH_3$.

The present invention provides a toner having a toner particle including a binder resin and a crystalline material, wherein the binder resin includes a vinyl resin having an ether structure, and where a peak intensity of secondary ion mass/secondary ion charge number (m/z) derived from a following structural formula (1) is denoted by E (ppm), and peak intensity derived from a following structural formula (3) is denoted by F (ppm), a following formula (4) is satisfied.

(4)

$$(F/E) \leq 1.00$$

(1)

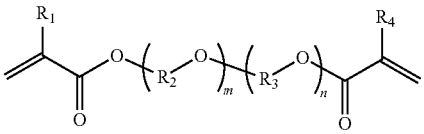

In the structural formula (1), m+n is an integer of 2 or more, $R_1$ and $R_4$ independently represent H or $CH_3$, and $R_2$ and $R_3$ independently represent a hydrocarbon group having a linear or branched chain having from 2 to 12 carbon atoms.

(3)

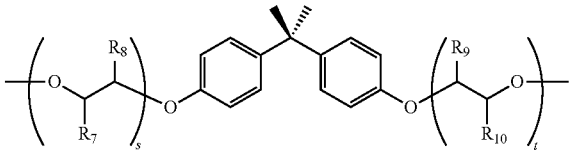

In the structural formula (3), s+t is an integer of 1 or more, and $R_7$, $R_8$, $R_9$, and $R_{10}$ each independently represent H or $CH_3$.

From the viewpoint of low-temperature fixing performance, the glass transition temperature (Tg) of the binder resin is preferably from 40.0° C. to 120.0° C.

The toner particle includes a crystalline material.

From the viewpoint of releasability, the crystalline material may include a wax.

The wax can be exemplified by known waxes.

Specific examples include petroleum waxes such as paraffin wax, microcrystalline wax, petrolactam, and derivatives thereof, montan wax and derivatives thereof, hydrocarbon waxes obtained by the Fischer-Tropsch method and derivatives thereof, polyolefin waxes represented by polyethylene and polypropylene and derivatives thereof, natural waxes such as carnauba wax and candelilla wax and derivatives thereof, and ester waxes.

Here, the derivatives include oxides, block copolymers with vinyl monomers, and graft modified products.

Examples of suitable ester waxes include monoester compounds having one ester bond in one molecule, diester compounds having two ester bonds in one molecule, and polyfunctional ester compounds such as tetrafunctional ester compounds having four ester bonds in one molecule, hexafunctional ester compounds having six ester bonds in one molecule and the like.

The wax preferably includes at least one compound selected from the group consisting of hydrocarbon waxes such as paraffin waxes and the like, monoester compounds and diester compounds. The wax may be used alone or in combination of two or more.

The amount of the wax is preferably 1.0 part by mass to 30.0 parts by mass and 3.0 parts by mass to 25.0 parts by mass or less with respect to 100 parts by mass of the binder resin.

From the viewpoint of fixing performance, the crystalline material may include a crystalline polyester.

Examples of the crystalline polyester include polycondensation products of aliphatic diols and aliphatic dicarboxylic acids.

A polycondensation product of an aliphatic diol having from 2 to 12 carbon atoms and an aliphatic dicarboxylic acid having from 2 to 12 carbon atoms is preferable.

Examples of the aliphatic diol having from 2 to 12 carbon atoms include the following compounds. 1,2-Ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol and the like.

Also, an aliphatic diol having a double bond can be used. Examples of the aliphatic diol having a double bond include the following compounds. 2-Butene-1,4-diol, 3-hexene-1,6-diol, and 4-octene-1,8-diol.

Examples of the aliphatic dicarboxylic acid having from 2 to 12 carbon atoms include the following compounds.

Oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid, and lower alkyl esters and acid anhydrides of these aliphatic dicarboxylic acids.

Of these, sebacic acid, adipic acid and 1,10-decanedicarboxylic acid, and their lower alkyl esters and acid anhydrides are preferred. These may be used alone or in combination of two or more.

An aromatic dicarboxylic acid can also be used. Examples of the aromatic dicarboxylic acid include the following compounds.

Terephthalic acid, isophthalic acid, 2,6-naphthalenedicarboxylic acid and 4,4'-biphenyldicarboxylic acid. Among these, terephthalic acid is preferable in terms of availability and easy formation of a low-melting-point polymer.

Also, a dicarboxylic acid having a double bond can be used. A dicarboxylic acid having a double bond can be suitably used for suppressing hot offset at the time of fixing, because the entire resin can be crosslinked using the double bond thereof.

Examples of such dicarboxylic acids include fumaric acid, maleic acid, 3-hexenedioic acid and 3-octenedioic acid. Lower alkyl esters and acid anhydrides thereof are also included. Among these, fumaric acid and maleic acid are more preferable.

A method for producing the crystalline polyester is not particularly limited, and the crystalline polyester can be produced by a general polyester polymerization method in which a dicarboxylic acid component and a diol component are reacted. For example, a direct polycondensation method or a transesterification method can be used, and the appropriate production method can be used depending on the type of the monomer.

The amount of the crystalline polyester is preferably from 1.0 part by mass to 30.0 parts by mass, and more preferably from 3.0 parts by mass to 25.0 parts by mass with respect to 100 parts by mass of the binder resin.

The peak temperature of the maximum endothermic peak of the crystalline polyester measured using a differential scanning calorimeter (DSC) is preferably from 50.0° C. to 100.0° C. From the viewpoint of low-temperature fixing performance, the peak temperature is more preferably from 60.0° C. to 90.0° C.

The toner particle may include a colorant. Examples of the colorant include pigments, dyes, and magnetic bodies. These can be used alone or in combination of two or more.

Examples of black pigments include carbon black such as furnace black, channel black, acetylene black, thermal black, lamp black and the like. These can be used alone or in combination of two or more.

As a colorant suitable for yellow color, a pigment or a dye can be used.

Examples of the pigment include C. I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 155, 167, 168, 173, 174, 176, 180, 181, 183, 191, and C. I. Vat Yellow 1, 3, 20. Examples of the dye include C. I. Solvent Yellow 19, 44, 77, 79, 81, 82, 93, 98, 103, 104, 112, 162 and the like. These can be used alone or in combination of two or more.

As a colorant suitable for cyan color, a pigment or a dye can be used.

Examples of the pigment include C. I. Pigment Blue 1, 7, 15, 15:1, 15:2, 15:3, 15:4, 16, 17, 60, 62, 66, and the like, C. I. Vat Blue 6, and C. I. Acid Blue 45. Examples of the dye include C. I. Solvent Blue 25, 36, 60, 70, 93, 95 and the like. These can be used alone or in combination of two or more.

As a colorant suitable for magenta color, a pigment or a dye can be used.

Examples of the pigment include C. I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 220, 221, 238, 254, and the like, C. I. Pigment Violet 19, and C. I. Vat Red 1, 2, 10, 13, 15, 23, 29, 35.

Examples of magenta dyes include oil-soluble dyes such as C. I. Solvent Red 1, 3, 8, 23, 24, 25, 27, 30, 49, 52, 58, 63, 81, 82, 83, 84, 100, 109, 111, 121, 122, and the like, C. I. Disperse Red 9, C. I. Solvent Violet 8, 13, 14, 21, 27, and the like, C. I. Disperse Violet 1, and basic dyes such as C. I. Basic Red 1, 2, 9, 12, 13, 14, 15, 17, 18, 22, 23, 24, 27, 29, 32, 34, 35, 36, 37, 38, 39, 40, and the like, C. I. Basic Violet 1, 3, 7, 10, 14, 15, 21, 25, 26, 27, 28, and the like. These can be used alone or in combination of two or more.

The amount of the colorant (other than the magnetic body) is preferably from 1 part by mass to 20 parts by mass, and more preferably from 2 parts by mass to 15 parts by mass with respect to 100 parts by mass of the binder resin.

The toner particle may include a magnetic body as a colorant.

Examples of the magnetic body include magnetic iron oxides such as magnetite, maghemite, ferrite and the like; metals such as iron, cobalt, and nickel, or alloys of these metals with metals such as aluminum, copper, magnesium, tin, zinc, beryllium, calcium, manganese, selenium, titanium, tungsten, and vanadium, and mixtures thereof.

The number average particle diameter of primary particles of the magnetic material is preferably 0.50 μm or less, and more preferably from 0.05 μm to 0.30 μm.

The number average particle diameter of the primary particles of the magnetic body present in the toner particle can be measured using a transmission electron microscope.

Specifically, the toner particles to be observed are sufficiently dispersed in an epoxy resin and then curing is performed in an atmosphere at a temperature of 40° C. for 2 days to obtain a cured product. A flaky sample is obtained from the obtained cured product with a microtome, an image with a magnification of 10,000 to 40,000 times is captured with a transmission electron microscope (TEM), and the projected area of 100 primary particles of the magnetic body in the image is measured. The equivalent diameter of a circle equal to the projected area is defined as the particle diameter of the primary particles of the magnetic body, and the average value for the 100 particles is defined as the number average particle diameter of the primary particles of the magnetic body.

The amount of the magnetic body is preferably from 20 parts by mass to 100 parts by mass, and more preferably from 25 parts by mass to 90 parts by mass with respect to 100 parts by mass of the binder resin.

The amount of the magnetic body in the toner can be measured using a thermal analyzer TGA Q5000IR manufactured by PerkinElmer, Inc. In the measurement method, the toner is heated from normal temperature to 900° C. at a temperature rising rate of 25° C./min in a nitrogen atmosphere, the weight loss in the range of 100° C. to 750° C. is defined as the mass of the toner components other than the magnetic body, and the remaining mass is taken as the amount of magnetic body.

A method for manufacturing magnetic bodies can be exemplified by the following method.

An aqueous solution including ferrous hydroxide is prepared by adding an alkali such as sodium hydroxide or the like in an amount equivalent to or greater than the iron component to a ferrous salt aqueous solution. Air is blown in while maintaining the pH of the prepared aqueous solution at pH 7 or higher, and ferrous hydroxide is oxidized while the aqueous solution is heated to 70° C. or higher to first produce seed crystals for the cores of the magnetic iron oxide.

Next, an aqueous solution including about 1 equivalent of ferrous sulfate, based on the amount of the alkali added previously, is added to the slurry liquid including seed crystals. While maintaining the pH of the solution at 5 to 10 and blowing air, the reaction of ferrous hydroxide is advanced to grow magnetic iron oxide with the seed crystals as the cores. At this time, it is possible to control the shape and magnetic characteristics of the magnetic bodies by selecting at random pH, reaction temperature, and stirring conditions. As the oxidation reaction proceeds, the pH of the liquid mixture shifts to the acidic side, but the pH of the liquid mixture is preferably not less than 5. The magnetic bodies can be obtained by using conventional methods for filtering, washing, and drying the magnetic bodies that were thus obtained.

Further, the magnetic bodies may be subjected to a known surface treatment as necessary.

Examples of the coupling agent that can be used in the surface treatment of the magnetic body include a silane coupling agent, a titanium coupling agent and the like. It is more preferable that a silane coupling agent represented by a following formula (I) be used.

$$R_mSiY_n \quad (I)$$

In the formula (I), R represents an alkoxy group (preferably having 1 to 3 carbon atoms), m represents an integer of 1 to 3, Y represents a functional group such as an alkyl group (preferably having 2 to 20 carbon atoms), a phenyl group, a vinyl group, an epoxy group, an acryl group, or a methacryl group, and n represents an integer of 1 to 3. However, m+n=4.

Examples of the silane coupling agent represented by the formula (I) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyl triacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, n-octadecyltrimethoxysilane and the like.

Among these, from the viewpoint of imparting high hydrophobicity to the magnetic bodies, it is preferable to use an alkyltrialkoxysilane coupling agent represented by the following formula (II).

$$C_pH_{2p+1}—Si—(OC_qH_{2q+1})_3 \quad (II)$$

In the formula (II), p represents an integer of 2 to 20, and q represents an integer of 1 to 3.

When p in the above formula is 2 or more, the magnetic bodies can be made sufficiently hydrophobic. When p is 20 or less, the hydrophobicity is sufficient, and the coalescence of the magnetic bodies can be suppressed. Furthermore, when q is 3 or less, the reactivity of the silane coupling agent is satisfactory and hydrophobization is likely to be sufficiently performed.

Therefore, it is preferable to use an alkyltrialkoxysilane coupling agent in which p in the formula represents an integer of 2 to 20 (more preferably an integer of 3 to 15) and q represents an integer of 1 to 3 (more preferably 1 or 2).

The silane coupling agents can be used alone or in combination of a plurality thereof for the treatment. When a plurality of coupling agents is used in combination, the treatment may be performed with each coupling agent individually or simultaneously.

The total treatment amount of the coupling agent to be used is preferably 0.9 parts by mass to 3.0 parts by mass with respect to 100 parts by mass of the magnetic bodies, and it is preferable to adjust the amount of the treatment agent according to the surface area of the magnetic bodies, the reactivity of the coupling agent and the like.

The toner particle may include a charge control agent. The toner is preferably a negatively chargeable toner.

Organometallic complex compounds and chelate compounds are effective as charge control agents for negative charging and can be exemplified by monoazo metal complex compounds; acetylacetone metal complex compounds; metal complexes of aromatic hydroxycarboxylic acids or aromatic dicarboxylic acids, and the like.

Specific examples of commercially available products, include Spilon Black TRH, T-77, T-95 (Hodogaya Chemical Co., Ltd.), BONTRON (registered trademark)S-34, S-44, S-54, E-84, E-88, E-89 (Orient Chemical Co., Ltd.).

These charge control agents can be used alone or in combination of two or more. From the viewpoint of charge quantity of the toner, the amount of the charge control agent used is preferably from 0.1 parts by weight to 10.0 parts by weight, and more preferably from 0.1 parts by weight to 5.0 parts by weight with respect to 100 parts by weight of the binder resin.

If necessary, the toner particle may be mixed with an external additive to improve toner flowability and/or charging performance.

For mixing the external additive, a known apparatus such as a Mitsui Henschel mixer (manufactured by Mitsui Miike Chemical Co., Ltd.) may be used.

Examples of the external additive include inorganic fine particles such as silica fine particles, titanium oxide fine particles, alumina fine particles and the like. As the silica fine particles, for example, both dry silica called dry-process silica or fumed silica which is produced by vapor phase oxidation of a silicon halide and so-called wet silica produced from water glass can be used.

However, dry silica is preferred because it has few silanol groups on the surface and inside of the silica fine particles, and few production residues such as $Na_2O$, $SO_3^{2-}$ and the like.

In the production process of dry silica, composite fine particles of silica and other metal oxides can be obtained by using other metal halogen compounds such as aluminum chloride and titanium chloride together with silicon halogen compounds, and dry silica is inclusive of such composite fine particles.

The amount of the inorganic fine particles is preferably from 0.1 parts by mass to 3.0 parts by mass with respect to 100 parts by mass of the toner particles. The amount of the inorganic fine particles may be quantified from a calibration curve prepared from a standard sample using a fluorescent X-ray analyzer.

The external additive can be exemplified by inorganic fine particles having a number average particle diameter of primary particles of from 4 nm to 80 nm, and inorganic fine particles of from 6 nm to 40 nm can be suitably exemplified.

When the inorganic fine particles are subjected to a hydrophobizing treatment, the charging performance and environmental stability of the toner can be further improved. Examples of treatment agents suitable for the hydrophobizing treatment include silicone varnish, various modified silicone varnishes, silicone oil, various modified silicone oils, silane compounds, silane coupling agents, other organosilicon compounds, organotitanium compounds and the like. These treatment agents may be used alone or in combination of two or more.

The number average particle diameter of the primary particles of the inorganic fine particles may be calculated using an image of the toner that has been enlarged and captured by a scanning electron microscope (SEM).

A method for producing the toner particles is not particularly limited, and any of dry production methods (for example, kneading and pulverization method and the like) and wet production methods (for example, emulsion aggregation method, suspension polymerization method, dissolution suspension method, and the like) may be used. Among these, it is preferable to use a suspension polymerization method.

In the suspension polymerization method, for example, a polymerizable monomer that can form a binder resin, and, if necessary, a magnetic body, a polymerization initiator, a crosslinking agent, a charge control agent, and other additives are uniformly dispersed to obtain a polymerizable monomer composition. Thereafter, the obtained polymerizable monomer composition is dispersed and granulated in a continuous layer (for example, an aqueous phase) including a dispersion stabilizer by using an appropriate stirrer, and polymerized using the polymerization initiator to obtain toner particles having a desired particle diameter.

As the polymerization initiator to be used in the production of toner particles by the suspension polymerization method, those having a half-life of from 0.5 h to 30 h during the polymerization reaction are preferable. Moreover, it is preferable to use the polymerization initiator with the addition amount of from 0.5 parts by mass to 20 mass by mass with respect to 100 mass parts of the polymerizable monomers. As a result, a polymer having a maximum molecular weight between 5,000 and 50,000 can be obtained, and the toner can be provided with preferable strength and appropriate melting characteristics.

Specific examples of the polymerization initiator include azo- or diazo-based polymerization initiators such as 2,2'-azobis-(2,4-dimethylvaleronitrile), 2,2'-azobisisobutyronitrile, 1,1'-azobis (cyclohexane-1-carbohynitrile), 2,2'-azobis-4-methoxy-2,4-dimethylvaleronitrile, azobisisobutyronitrile and the like; and peroxide-based polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, t-butylperoxypivalate, di(2-ethylhexyl) peroxydicarbonate, di(secondary butyl) peroxydicarbonate and the like. Of these, t-butyl peroxypivalate is preferable.

A dispersion stabilizer may be included in the aqueous medium in which the polymerizable monomer composition is dispersed.

As the dispersion stabilizer, known surfactants, organic dispersing agents, and inorganic dispersing agents can be used. Among these, inorganic dispersing agents can be preferably used because they ensure dispersion stability due to the steric hindrance thereof, so that the stability is not easily lost even when the reaction temperature is changed, and are easily washed and do not adversely affect the toner.

Examples of these inorganic dispersing agents include polyvalent metal salts of phosphoric acid such as tricalcium phosphate, magnesium phosphate, aluminum phosphate, zinc phosphate, hydroxyapatite and the like, carbonates such as calcium carbonate, magnesium carbonate and the like, inorganic salts such as calcium metasilicate, calcium sulfate, barium sulfate and the like, and inorganic compounds such as calcium hydroxide, magnesium hydroxide, aluminum hydroxide and the like.

The addition amount of the inorganic dispersing agent is preferably from 0.2 parts by mass to 20.0 parts by mass with respect to 100 parts by mass of the polymerizable monomer. Moreover, the above dispersion stabilizer may be used independently and a plurality of kinds thereof may be used together. Furthermore, from 0.001 mass part to 0.1 mass part of a surfactant may be used in combination. In the case of using the inorganic dispersing agent, the dispersing agent may be used as it is, but in order to obtain finer particles, particles of the inorganic dispersing agent can be generated and used in an aqueous medium.

For example, in the case of tricalcium phosphate, a sodium phosphate aqueous solution and a calcium chloride aqueous solution can be mixed under high-speed stirring to produce water-insoluble calcium phosphate fine particles, which enables more uniform and fine dispersion. At this time, water-soluble sodium chloride salt is concurrently produced as a by-product. Existence of any water-soluble salt in an aqueous medium is preferable because dissolution of the polymerizable monomer to water is suppressed, which leads to less generation of ultrafine toner by emulsion polymerization.

Examples of the surfactant include sodium dodecylbenzene sulfate, sodium tetradecyl sulfate, sodium pentadecyl sulfate, sodium octyl sulfate, sodium oleate, sodium laurate, sodium stearate, potassium stearate and the like.

In the step of polymerizing the polymerizable monomer, the polymerization temperature may be set usually 40° C. or higher, preferably from 50° C. to 90° C. Where the polymerization is performed in this temperature range, for example, a release agent or the like that is to be sealed inside is precipitated by phase separation, and the encapsulation becomes more complete.

Thereafter, a cooling step of cooling from a reaction temperature of about 50° C. to 90° C. is performed to finish the polymerization reaction step.

After completion of the polymerization of the polymerizable monomer, toner particles are obtained by filtering, washing, and drying the obtained polymer particles by a known method. A toner can be obtained by mixing the toner particles with an external additive and adhering the external additive to the surface of the toner particles. It is also possible to add a classification step to the production process to cut coarse powder and fine powder contained in the toner particles.

The toner may further include other additives within a range in which no substantial adverse effect is produced.

Examples of such additives include lubricant powder such as fluororesin powder, zinc stearate powder, polyvinylidene fluoride powder and the like; an abrasive such as cerium oxide powder, silicon carbide powder, strontium titanate powder and the like; an anti-caking agent and the like. The additive can also be used after the surface thereof is hydrophobized.

The glass transition temperature (Tg) of the toner is preferably from 45.0° C. to 65.0° C., and more preferably from 50.0° C. to 65.0° C.

When the glass transition temperature is in the above range, both storage stability and low-temperature fixing performance can be achieved at a high level. The glass transition temperature can be controlled by the composition of the binder resin, the kind of the crystalline polyester, the molecular weight of the binder resin, and the like.

The weight average particle diameter (D4) of the toner is preferably from 3.0 μm to 8.0 μm, and more preferably from 5.0 μm to 7.0 μm.

By setting the weight average particle diameter (D4) of the toner within the above range, it is possible to satisfactorily satisfy the dot reproducibility while improving the toner handling property.

Further, the ratio (D4/D1) of the weight average particle diameter (D4) to the number average particle diameter (D1) of the toner is preferably less than 1.25.

Hereinafter, the measuring method of each physical property value according to the present invention will be described.

Method for Measuring Weight Average Particle Diameter (D4) and Number Average Particle Diameter (D1) of Toner (Particles)

The weight average particle diameter (D4) and number average particle diameter (D1) of the toner (particles) are calculated as follows.

A precision particle size distribution measuring device (trade name: Coulter Counter Multisizer 3) based on a pore electric resistance method and equipped with a 100 μm aperture tube is used as a measuring device. Dedicated software (trade name: Beckman Coulter Multisizer 3, Version 3.51, manufactured by Beckman Coulter, Inc.) is used for setting measurement conditions and analyzing measurement data. The measurement is performed with 25,000 effective measurement channels.

For example, "ISOTON II" (manufactured by Beckman Coulter, Inc.), which is a solution prepared by dissolving special grade sodium chloride in ion exchanged water to a concentration of about 1% by mass, can be used as an electrolytic aqueous solution for measurements.

The dedicated software is set up in the following manner before the measurement and analysis.

The total count number in a control mode is set to 50,000 particles on a "CHANGE STANDARD MEASUREMENT METHOD (SOM)" screen of the dedicated software, the number of measurements is set to 1, and a value obtained using (standard particles 10.0 μm, manufactured by Beckman Coulter, Inc.) is set as a Kd value. The threshold and the noise level are automatically set by pressing a "MEASUREMENT BUTTON OF THRESHOLD/NOISE LEVEL". Further, the current is set to 1600 μA, the gain is set to 2, the electrolytic solution is set to ISOTON II (trade name), and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

The specific measurement method is described hereinbelow.

(1) Approximately 200 mL of the electrolytic aqueous solution is placed in a dedicated glass 250 mL round-bottom beaker of Multisizer 3, the beaker is set in a sample stand, and stirring with a stirrer rod is carried out counterclockwise at 24 revolutions per second. Dirt and air bubbles in the aperture tube are removed by the "FLUSH OF APERTURE TUBE" function of the dedicated software.

(2) About 30 mL of the electrolytic aqueous solution is placed in a glass 100 mL flat-bottom beaker. Then, about 0.3 mL of a diluted solution obtained by about 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersing agent thereto.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchanged water is added in the water tank of the ultrasonic disperser, and then about 2 mL of the CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner (particles) is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 sec. In the ultrasonic dispersion, the water temperature in the water tank is appropriately adjusted to a temperature of from 10° C. to 40° C.

(6) The electrolytic aqueous solution of (5) hereinabove in which the toner (particles) is dispersed is dropped using a pipette into the round bottom beaker of (1) hereinabove which is set in the sample stand, and the measurement concentration is adjusted to be about 5%. Then, measurement is conducted until the number of particles to be measured reaches 50,000.

(7) The measurement data are analyzed with the dedicated software provided with the apparatus, and the weight average particle diameter (D4) and the number average particle diameter (D1) are calculated. The "AVERAGE DIAMETER" on the "ANALYSIS/VOLUME STATISTICAL VALUE (ARITHMETIC MEAN)" screen when the dedicated software is set to graph/volume % is the weight average particle diameter (D4). The "AVERAGE DIAMETER" on the "ANALYSIS/NUMBER STATISTICAL VALUE (ARITHMETIC MEAN)" screen when the dedicated software is set to graph/number % is the number average particle diameter (D1).

Method for Measuring Peak Temperature (or Melting Point) of Maximum Endothermic Peak The peak temperature of the maximum endothermic peak of the toner or crystalline material is measured under the following conditions by using a differential scanning calorimeter (DSC) Q2000 (TA Instruments).

Temperature rise rate: 10° C./min
Measurement start temperature: 20° C.
Measurement end temperature: 180° C.

The temperature correction of the device detection unit is performed using the melting points of indium and zinc, and the heat correction is performed using the heat of fusion of indium.

Specifically, about 5 mg of a sample is accurately weighed, placed in an aluminum pan, and measured once. An aluminum empty pan is used as a reference. The peak temperature of the maximum endothermic peak at that time is obtained. For wax and the like, the peak temperature of the maximum endothermic peak is taken as the melting point.

Method for Measuring Glass Transition Temperature (Tg)

The glass transition temperature of toner or resin is a temperature (° C.) at a point where a straight line equidistant in the vertical axis direction from a straight line obtained by extending the baseline before and after the change in specific heat in the reversing heat flow curve during temperature rise, which is obtained by differential scanning calorimetry of the peak temperature of the maximum endothermic peak, intersects with the curve of a stepwise change portion of glass transition in the reversing heat flow curve.

Method for Measuring Weight Average Molecular Weight (Mw) and Peak Molecular Weight (Mp) of Resin, etc.

The weight average molecular weight (Mw) and peak molecular weight (Mp) of the resin and the other materials are measured using gel permeation chromatography (GPC) in the following manner.

(1) Preparation of Measurement Sample

A sample and tetrahydrofuran (THF) are mixed at a concentration of 5.0 mg/mL. The mixture is allowed to stand at room temperature for 5 h to 6 h and then shaken thoroughly, and the sample and THF are mixed well till the sample aggregates are loosened. The components are thereafter further allowed to stand for 12 h or more at room temperature. At this time, the time from the start of mixing of the sample and THF to the end of standing is set to be 72 h or more to obtain tetrahydrofuran (THF) soluble matter of the sample.

Subsequent filtration through a solvent-resistant membrane filter (pore size: 0.45 μm to 0.50 μm, Myshory Disc H-25-2 (manufactured by Tosoh Corporation)) produces a sample solution.

(2) Measurement of Sample

Measurement is performed under the following conditions using the obtained sample solution.

Device: high-speed GPC device LC-GPC 150C (manufactured by Waters Co.)
Column: 7 series of Shodex GPC KF-801, 802, 803, 804, 805, 806, 807
(manufactured by Showa Denko K.K.)
Mobile phase: THF
Flow rate: 1.0 mL/min
Column temperature: 40° C.
Sample injection volume: 100 μL
Detector: RI (refractive index) detector When measuring the molecular weight of the sample, the molecular weight distribution of the sample is calculated from the relationship between the logarithmic value of the calibration curve prepared using several types of monodispersed polystyrene standard samples and the count number.

Samples produced by Pressure Chemical Co. or Toyo Soda Industry Co., Ltd. and having a molecular weight of $6.0\times10^2$, $2.1\times10^3$, $4.0\times10^3$, $1.75\times10^4$, $5.1\times10^4$, $1.1\times10^5$, $3.9\times10^5$, $8.6\times10^5$, $2.0\times10^6$, and $4.48\times10^6$ are used as standard polystyrene samples for preparation of the calibration curve.

Method for Measuring Particle Diameter of Fine Particles in Fine Particle-Dispersed Solution The particle diameter of fine particles in each fine particle-dispersed solution is measured using a laser diffraction/scattering particle size distribution measuring device. Specifically, the measurement is performed according to JIS Z8825-1 (2001). As a measuring device, a laser diffraction/scattering particle size distribution measuring device "LA-920" (manufactured by Horiba, Ltd.) is used. The dedicated software "HORIBA LA-920 for Windows (registered trademark) WET (LA-920) Ver. 2.02" provided with the LA-920 is used for setting the measurement conditions and analyzing the measurement data. As the measurement solvent, ion exchanged water from which impure solids are removed in advance is used. The measurement procedure is as follows.

(1) A batch-type cell holder is attached to the LA-920.

(2) A predetermined amount of ion exchanged water is placed into a batch-type cell, and the batch-type cell is set in the batch-type cell holder.

(3) The inside of the batch-type cell is stirred using a dedicated stirrer chip.

(4) The "REFRACTIVE INDEX" button on the "DISPLAY CONDITION SETTING" screen is pressed to set the relative refractive index to a value corresponding to the fine particles.

(5) In the "DISPLAY CONDITION SETTING" screen, the particle diameter standard is set as the volume standard.

(6) After performing warm-up operation for 1 h or longer, optical axis adjustment, optical axis fine adjustment, and blank measurement are performed.

(7) A total of 3 mL of the fine particle-dispersed solution is placed in a glass 100 mL flat bottom beaker. Further, 57 mL of ion exchange water is added to dilute the resin fine particle-dispersed solution. Then, about 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added as a dispersing agent thereto.

(8) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. A total of 3.3 L of ion exchanged water is added in the water tank of the ultrasonic disperser, and then 2 mL of the CONTAMINON N is added to the water tank.

(9) The beaker of (7) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(10) Then, the ultrasonic dispersion process is further continued for 60 sec. In the ultrasonic dispersion, the water temperature in the water tank is appropriately adjusted to a temperature of from 10° C. to 40° C.

(11) The fine particle-dispersed solution prepared in (10) hereinabove is directly added little by little to the batch-type cell while taking care not to introduce bubbles, and the transmittance of a tungsten lamp is adjusted to 90% to 95%. Then, the particle size distribution is measured. Based on the obtained volume-based particle size distribution data, the particle diameter of the fine particles in the fine particle-dispersed solution is calculated.

Method for Measuring Secondary Ion Mass/Secondary Ion Charge Number (m/z) by Time-of-Flight Secondary Ion Mass Spectrometry (TOF-SIMS)

For measurement of peak intensity using TOF-SIMS, TRIFT-IV manufactured by ULVAC-PHI is used.

The analysis conditions are as follows.

Sample preparation: the toner is attached to an indium sheet
Sample pretreatment: none
Primary ion: Au ion
Accelerating voltage: 30 kV
Charge neutralization mode: On
Measurement mode: Positive
Raster: 200 μm
Measurement time: 60 s Calculation of peak intensity: according to ULVAC-PHI standard software (Win Cadense), the total count number at a mass number of 43.5 to 44.5 is taken as the peak intensity at (m/z) 44.

Similarly, the total count number at 55.5 to 56.5 is taken as (m/z) 56, the total count number at 58.5 to 59.5 is taken as (m/z) 59, and the total count number at 134.5 to 135.5 is taken as (m/z) 135.

Usually, TOF-SIMS is a surface analysis method, and data in the depth direction are about 1 nm data. Therefore, the intensity inside the toner is determined by sputtering the toner with argon gas cluster ions and scraping the surface.

Sputtering conditions are as follows.

Accelerating voltage: 10 kV
Current: 3.4 nA
Raster: 600 μm
Irradiation time: 5 s The depth measurement was performed by sputtering a PMMA film under the same conditions in advance to confirm the relationship with the irradiation time, and it was confirmed that 100 nm was cut in 300 s.

In the toner of the present invention, the intensity at 100 nm from the toner surface is taken as a value obtained by measuring secondary ion mass/secondary ion charge number (m/z) when sputtering 120 times under the above conditions.

Further, the intensity at the outermost surface of the toner is taken as a value of secondary ion mass/secondary ion charge number (m/z) measured without sputtering the toner, after the external additive has been removed by the below-described method.

Removal of External Additive (1) For Non-Magnetic Toner

A total of 160 g of sucrose (manufactured by Kishida Chemical Co., Ltd.) is added to 100 mL of ion exchanged water and dissolved while forming a hot water bath to prepare a concentrated sucrose solution. Then, 31 g of the concentrated sucrose solution and 6 mL of CONTAMINON N (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) are placed in a centrifuge tube to prepare a dispersion liquid. To this dispersion liquid, 1 g of the toner is added, and the lump of the toner is loosened with a spatula or the like.

The centrifuge tube is shaken for 30 min with a shaker under a condition of 350 strokes per minute. After shaking, the solution is transferred to a glass tube (capacity 50 mL) for a swing rotor, and centrifugally separated by a centrifuge (H-9R manufactured by Kokusan Co., Ltd.) under a condition of 58.33 $S^{-1}$ for 30 min. In the glass tube after centrifugation, the toner is present in the uppermost layer, and the external additive is present in the aqueous solution side of the lower layer. The toner of the upper layer is collected and filtered and then washed with 2 L of running ion exchange water warmed to 40° C., and the washed toner is taken out.

(2) For Magnetic Toner

A dispersion medium is prepared by placing 6 mL of "CONTAMINON N" (10% by mass aqueous solution of a neutral detergent with a pH of 7 for washing precision measuring instruments; includes a nonionic surfactant, an anionic surfactant and an organic builder) in 100 mL of ion exchanged water. To this dispersion medium, 5 g of toner is added and dispersed for 5 min with an ultrasonic disperser (AS ONE Corp., VS-150). After that, the dispersion medium with the toner is set in "KM Shaker" (model: V. SX) manufactured by Iwaki Sangyo Co., Ltd. and shaken for 20 min under the condition of 350 strokes per minute.

After that, the toner is restrained and collected using a neodymium magnet. The toner is washed with 2 L of ion exchanged water heated to 40° C., and the washed toner is taken out.

Method for Measuring Hardness by Nanoindentation Method

The toner hardness is measured by the nanoindentation method by using Picodenter HM500 manufactured by Fisher Instrument Co., Ltd. The software WIN-HCU provided with the device is used. A Vickers indenter (angle: 130°) is used as the indenter.

The measurement includes a step of pushing the indenter till a predetermined load is obtained for a predetermined time (hereinafter referred to as "indentation step"). In this measurement, the load application speed is changed by changing the set time and load.

First, a microscope displayed on the software is focused on a video camera screen connected to the microscope. Then, a glass plate (hardness: 3600 N/mm$^2$) for performing the Z-axis alignment described hereinbelow is used for the target object for focusing. At this time, the objective lens is sequentially focused from 5× to 20× and 50×. Thereafter, adjustment is performed with a 50× objective lens.

Next, the "Approach Parameter Setting" operation is performed using the glass plate that has been focused as described above, and the Z-axis alignment of the indenter is performed. Thereafter, the glass plate is replaced with an acrylic plate, and a "Cleaning of Indenter" operation is performed. The "Cleaning of Indenter" operation means that the tip of the indenter is wiped with a cotton swab moistened with ethanol, and at the same time, the indenter position designated on the software is matched with the indenter position on the hardware, that is, the operation of XY-axis alignment of the indenter is performed.

After that, the acrylic plate is changed to a slide glass to which the toner has been attached, and the microscope is focused on the toner to be measured. The method for attaching the toner to the slide glass is as follows.

First, the toner to be measured is attached to the tip of a cotton swab, and excess toner is screened off with the edge of a bottle. Thereafter, the toner attached to the swab is tapped off onto the slide glass so as to form a toner monolayer while pressing the swab shaft against the edge of the slide glass.

After that, the slide glass to which the toner monolayer has been attached as described hereinabove is set on the microscope, the microscope is focused on the toner with a 50× objective lens, and the indenter tip is set, on the software, to arrive at the center of the toner particle. The toner to be selected is limited to particles in which both the major axis and the minor axis are in the range of weight average particle diameter D4 (μm)±1.0 μm.

The measurement is performed by carrying out the indentation step under the following conditions.

Indentation Step 1

Maximum indentation load=0.25 mN

Indentation time=300 sec

The load application speed of 0.83 μN/sec can be set by the above conditions.

Indentation Step 2

Maximum indentation load=0.50 mN

Indentation time=200 sec

The load application speed of 2.5 μN/sec can be set by the above conditions.

Slopes determined by linear approximation by the least square method of data in a displacement region of from 0.00 μm to 0.20 μm from a load-displacement curve obtained in these two indentation steps where a load a (mN) is plotted against the ordinate and a displacement amount b (μm) is plotted against the abscissa are taken as toner hardness A and B. The displacement value at which a positive load is measured for the first time is defined as the initial displacement value (0.00 μm). Further, data in a section of from 0.00 μm to 0.20 μm are collected for 100 points or more.

The above measurement is performed on 30 toner particles, and an arithmetic average value is used.

In the measurement, the above-described "Cleaning of Indenter" operation (including XY-axis alignment of the indenter) is necessarily performed for each particle measurement.

Regarding the toner hardness C, a toner hardness (N/m) is plotted against the ordinate, a load application speed (μN/sec) is plotted against the abscissa, a intercept of a straight line passing through the toner hardness A and the toner hardness B is obtained, and a value (N/m) of C at a point of time at which the load application speed is 0.00 μN/sec is obtained as the toner hardness C (N/m).

EXAMPLES

Hereinafter, the present invention will be described in greater detail with reference to Examples and Comparative Examples, but the present invention is not limited thereto. "Parts" used in Examples and Comparative Examples are based on mass unless otherwise specified.

Production Example of Amorphous Polyester A1

| | |
|---|---|
| Terephthalic acid | 30.0 parts |
| Trimellitic acid | 5.0 parts |
| Bisphenol A ethylene oxide (2 mol) adduct | 160.0 parts |
| Dibutyltin oxide | 0.1 part |

The above materials were placed into a heat-dried two-necked flask, nitrogen gas was introduced into a container, and the temperature was raised while stirring in an inert atmosphere. Thereafter, a polycondensation reaction was performed at 150° C. to 230° C. for about 12 h, and then the pressure was gradually reduced at 210° C. to 250° C. to obtain a polyester A1.

Polyester A1 had a number average molecular weight (Mn) of 18,200, a weight average molecular weight (Mw) of 74,100, and a glass transition temperature (Tg) of 77.0° C.

Production Example of Amorphous Polyester A2

| | |
|---|---|
| Terephthalic acid | 104.5 parts |
| Adipic acid | 6.0 parts |
| Trimellitic acid | 12.5 parts |
| Propylene glycol | 43.1 parts |
| 1,4-Butanediol | 50.1 parts |
| Dibutyltin oxide | 0.1 part |

The above materials were placed into a heat-dried two-necked flask, and nitrogen gas was introduced into a container, and the temperature was raised while stirring in an inert atmosphere. Thereafter, a polycondensation reaction was performed at 150° C. to 230° C. for about 12 h, and then the pressure was gradually reduced at 210° C. to 250° C. to obtain a polyester A2.

The polyester A2 had a number average molecular weight (Mn) of 20,200, a weight average molecular weight (Mw) of 82,600, and a glass transition temperature (Tg) of 57.6° C.

Production Example of Crystalline Polyester B 1

| | |
|---|---|
| Sebacic acid | 123.7 parts |
| 1,9-Nonanediol | 76.3 parts |
| Dibutyltin oxide | 0.1 part |

The above materials were placed into a heat-dried two-necked flask, nitrogen gas was introduced into a container, and the temperature was raised while stirring in an inert atmosphere. Then, stirring was performed at 180° C. for 6 h. Thereafter, the temperature was gradually raised to 230° C. under reduced pressure while continuing the stirring, and the temperature was further maintained for 2 h. Once a viscous state has been assumed, air cooling was performed to stop the reaction, thereby obtaining a crystalline polyester B 1.

The crystalline polyester B 1 had a weight average molecular weight (Mw) of 39,500 and a melting point of 66.0° C.

Production Example of Magnetic Bodies C1

A total of 55 liters of 4.0 mol/L sodium hydroxide aqueous solution was mixed and stirred with 50 liters of ferrous sulfate aqueous solution including $Fe^{2+}$ at 2.0 mol/L to obtain a ferrous salt aqueous solution including ferrous hydroxide colloid. This aqueous solution was kept at 85° C., and an oxidation reaction was performed while blowing air at 20 L/min to obtain a slurry including core particles.

The obtained slurry was filtered and washed with a filter press, and then the core particles were redispersed in water. 0.20% by mass of sodium silicate in terms of silicon per 100 parts of the core particles was added to the resulting reslurry liquid, the pH of the slurry liquid was adjusted to 6.0, and stirring was performed to obtain magnetic iron oxide particles having a silicon-rich surface. As a silane coupling agent, 1.5 parts of n-$C_6H_3Si(OCH_3)_3$ was added to 100 parts of magnetic iron oxide followed by sufficient stirring.

The obtained slurry was filtered and washed with a filter press, and further reslurried with ion exchanged water. A total of 500 parts (10% by mass with respect to magnetic iron oxide) of ion exchange resin SK110 (manufactured by Mitsubishi Chemical Corporation) was loaded into to this reslurry liquid (solid fraction 50 parts/L), and ion exchange was performed by stirring for 2 h. Thereafter, the ion exchange resin was removed by filtration through a mesh, filtered and washed with a filter press, dried and pulverized to obtain magnetic bodies C1 having a number average particle diameter of primary particles of 0.21 m.

Production Example of Magnetic Bodies C2

Magnetic bodies C2 were obtained in the same manner as in Production Example of Magnetic Bodies C1 except that the addition amount of the silane coupling agent was changed to 1.2 parts.

Crosslinking Agent

As the crosslinking agent, a crosslinking agent having the structure shown in Table 1 in the structural formula (1) was prepared. In all cases, a crosslinking agent from Shin-Nakamura Chemical Co., Ltd. was used.

TABLE 1

| Crosslinking agent No. | Product name of crosslinking agent | $R_1$ | $R_2$ | $R_3$ | $R_4$ | m + n |
|---|---|---|---|---|---|---|
| L1 | APG-400 | H | $CH_3$ \| $CH-CH_2$ | $CH_3$ \| $CH_2-CH$ | H | 7 |
| L2 | APG-100 | H | $CH_3$ \| $CH-CH_2$ | $CH_3$ \| $CH_2-CH$ | H | 2 |
| L3 | APG-700 | H | $CH_3$ \| $CH-CH_2$ | $CH_3$ \| $CH_2-CH$ | H | 12 |
| L4 | A-1000 | H | $CH_2CH_2$ | $CH_2CH_2$ | H | 23 |

Production Example of Toner Particles 1

An aqueous medium including a dispersion stabilizer was obtained by adding 450 parts of a 0.1 mol/L-$Na_3PO_4$ aqueous solution to 720 parts of ion exchanged water, heating to 60° C. and then adding 67.7 parts of a 1.0 mol/L-$CaCl_2$ aqueous solution.

| | |
|---|---|
| Styrene | 78.0 parts |
| n-Butyl acrylate | 22.0 parts |
| Crosslinking agent L1 | 1.5 parts |
| Amorphous polyester resin A1 | 5.0 parts |
| Negative charge control agent T-77 (Hodogaya Chemical Co., Ltd.) | 1.0 part |
| Magnetic bodies C1 | 70.0 parts |

The above materials were uniformly dispersed and mixed using an attritor (Nippon Coke & Engineering Co., Ltd.).

The obtained monomer composition was heated to a temperature of 60° C., and the following materials were mixed and dissolved therein to obtain a polymerizable monomer composition.

| | |
|---|---|
| Release agent (paraffin wax (HNP-9: manufactured by Nippon Seiro Co., Ltd.)) | 15.0 parts |
| Crystalline polyester B1 | 5.0 parts |
| Polymerization initiator | 10.0 parts |

(t-butyl peroxypivalate (25% toluene solution))

The polymerizable monomer composition was placed into an aqueous medium, and granulated by stirring at a rotation speed of 10,000 rpm for 15 min with T. K. Homomixer (Tokushu Kika Kogyo Co., Ltd.) at a temperature of 60° C. in a nitrogen atmosphere.

Thereafter, stirring was performed with a paddle stirring blade, and a polymerization reaction was conducted at a reaction temperature of 70° C. for 300 min.

Thereafter, the obtained suspension was cooled to room temperature at 3° C. per minute, and hydrochloric acid was added to dissolve the dispersion stabilizer, followed by filtration, washing with water and drying to obtain toner particles 1. The formulations of the obtained toner particles 1 are shown in Table 2.

Production Example of Toner 1

A total of 0.3 parts of sol-gel silica fine particles having a number average particle diameter of primary particles of 115 nm were added to 100 parts of the toner particles 1 and mixed using an FM mixer (manufactured by Nippon Coke & Engineering Co., Ltd.). Thereafter, 0.9 parts of hydrophobic silica fine particles that were obtained by treating silica fine particles having a number average particle diameter of primary particles of 12 nm with hexamethyldisilazane and then treating with silicone oil and that had a BET specific surface area value of 120 $m^2/g$ after the treatment were added and mixed in the same manner by using an FM mixer (manufactured by Nippon Coke & Engineering Co., Ltd.) to obtain a toner 1. Physical properties of the toner 1 are shown in Table 1.

Example 1

LaserJet Pro M12 (manufactured by Hewlett-Packard Company) of a one-component contact development system that was modified to 200 mm/sec, which is higher than the original process speed, was used as an image forming apparatus.

The evaluation results are shown in Table 4. The evaluation method and evaluation criteria in each evaluation are as follows.

Evaluation 1: Evaluation of Storage Stability

In a storage stability test, after printing a solid image in a high-temperature and high-humidity environment (32.5° C., 80% RH), each developing device was stored for 30 days in a harsh environment (45.0° C., 90% RH). After storage, a solid image was outputted in a high-temperature and high-humidity environment (32.5° C., 80% RH), and comparative evaluation of image density before and after storage was performed. The density of the solid image was measured with a Macbeth reflection densitometer (manufactured by Macbeth Co.).

A: density difference is less than 0.05
B: density difference is from 0.05 to less than 0.10
C: density difference is from 0.10 to less than 0.20
D: density difference is 0.20 or more Evaluation 2: Evaluation of Flowability When the toner is stored for a long time in a high-temperature and high-humidity environment, a crystalline material such as a release agent may migrate to the surface, and the image quality may change. For this reason, the toner previously allowed to stand for 30 days in a harsh environment (45.0° C., 90% RH) was used.

As an evaluation procedure, the toner was allowed to stand in a normal-temperature and normal-humidity environment (25.0° C., 60% RH) for one day with the image forming apparatus, 15,000 prints of a horizontal line image with a print percentage of 1% were thereafter outputted in the intermittent mode in the abovementioned environment, and then three solid images were outputted. In the image quality evaluation, the density at 4 corners of the last 3 solid images was measured with a Macbeth reflection densitometer, and the 12 numerical values were evaluated according to the following criteria.

A: difference between the maximum value and the minimum value of image density is less than 0.10
B: difference between the maximum value and the minimum value of the image density is from 0.10 to less than 0.20
C: difference between the maximum value and the minimum value of the image density is from 0.20 to less than 0.25
D: difference between the maximum value and the minimum value of the image density is 0.25 or more Evaluation 3: Evaluation of Low-Temperature Fixing Performance Evaluation of low-temperature fixing performance was performed in a normal-temperature and normal-humidity environment (temperature 25.0° C., relative humidity 60%).

The image forming apparatus was modified so that the fixing temperature of the fixing device therein could be set arbitrarily. Using this apparatus, the temperature of the fixing device was controlled at intervals of 5° C. within the range of from 180° C. to 230° C., FOX RIVER BOND paper (110 $g/m^2$), which is rough paper, was used, and a solid black image was outputted with a print percentage of 100%. At this time, the presence of white spots in the solid image portion was visually evaluated, and the lowest temperature at which the white spot was generated was evaluated as the low-temperature fixing performance.

A: white spots occur at below 210° C.
B: white spots occur at from 210° C. to below 220° C.
C: white spots occur at from 220° C. to below 230° C.
D: white spots occur at 230° C. or higher Evaluation 4: Fogging on Paper After Output of Solid White Image in High-Humidity Environment Evaluation of fogging on paper after outputting a solid white image in a high-humidity environment was performed in a normal-temperature and high-humidity environment (25.0° C., 80% RH). The fogging was measured using a REFECTMETER MODEL TC-6DS manufactured by Tokyo Denshoku Co., Ltd. A green filter was used as the filter. The paper used for evaluation was business 4200 (manufactured by Xerox Corp.) having a basis weight of 75 $g/m^2$. In "fogging on paper after outputting a solid white image", 100 horizontal line images with a print percentage of 1% were printed on two intermittently passed sheets. Then, a sticky note was pasted on the center of the paper, and one white image was outputted. A difference was calculated by subtracting the reflectance of the white background portion outside the sticky note from the on-paper reflectance of the portion where the sticky note was removed.

Evaluation Criteria

A: less than 5.0%
B: from 5.0% to less than 10.0%
C: from 10.0% to less than 15.0%
D: 15.0% or more Evaluation 5: Coat Defects on Developing Sleeve In coatability evaluation of the developing sleeve, the state of the toner coat on the surface of the developing sleeve was observed after passing 5000 sheets in a low-temperature and low-humidity environment (15.0° C., 10% RH), and the presence/absence of coat defects (regulation defects) caused by excessive charging of the toner was visually observed according to the following criteria.

An image in a durability test was outputted in an intermittent mode in which a horizontal line with a print percentage of 1% was temporarily stopped every two sheets.

A: no coat defect is observed on the developing sleeve
B: a slight coat defect is present on the developing sleeve but it does not appear in the image
C: a clear coat defect is present on the developing sleeve but it does not appear in the image
D: a coat defect is present on the developing sleeve, and an image defect is caused by the coat defect Production Examples of Toner Particles 2 to 12, 14 and 15

Toner particles 2 to 12, 14 and 15 were obtained in the same manner as in Production Example of Toner Particles 1 except that changes were made as shown in Table 2.

Preparation of Resin Particle-Dispersed Solution 1

| | |
|---|---|
| Styrene | 75.0 parts |
| n-Butyl acrylate | 23.0 parts |
| β-Carboxyethyl acrylate | 2.0 parts |
| 1,6-Hexanediol diacrylate | 0.6 parts |

Dodecanethiol (manufactured by Wako Pure Chemical Industries, Ltd.) 0.7 parts

The above materials were mixed and dissolved and then dispersed and emulsified in a flask including a solution obtained by dissolving 1.0 part of an anionic surfactant (NEOGEN RK, manufactured by DKS Co., Ltd.) in 250 parts of ion exchanged water. Then, 50 parts of ion exchanged water in which 2 parts of ammonium persulfate was dissolved was added while slowly stirring and mixing for 10 min.

Next, after sufficiently purging the inside of the flask with nitrogen, the content was stirred and heated in an oil bath until the system reached 70° C., and emulsion polymerization was continued as is for 5 h.

As a result, a resin particle-dispersed solution 1 was obtained in which resin particles having a volume average particle diameter of 0.18 μm, a glass transition temperature of 56.5° C., and a weight average molecular weight of 30,000 were dispersed at a solid fraction concentration of 25.0% by mass.

Preparation of Resin Particle-Dispersed Solution 2

| | |
|---|---|
| Styrene | 78.0 parts |
| n-Butyl acrylate | 20.0 parts |
| β-Carboxyethyl acrylate | 2.0 parts |
| 1,6-Hexanediol diacrylate (HDDA in the table) | 1.0 parts |
| Dodecanethiol (manufactured by Wako Pure Chemical Industries, Ltd.) | 0.7 parts |

The above materials were mixed and dissolved and then dispersed and emulsified in a flask including a solution obtained by dissolving 1.0 part of an anionic surfactant (NEOGEN RK, manufactured by DKS Co., Ltd.) in 250 parts of ion exchanged water. Then, 50 parts of ion exchanged water in which 2 parts of ammonium persulfate was dissolved was added while slowly stirring and mixing for 10 min.

Next, after sufficiently purging the inside of the flask with nitrogen, the content was stirred and heated in an oil bath until the system reached 70° C., and emulsion polymerization was continued as is for 5 h.

As a result, a resin particle-dispersed solution 2 was obtained in which resin particles having a volume average particle diameter of 0.18 μm, a glass transition temperature of 60.2° C., and a weight average molecular weight of 38,000 were dispersed at a solid fraction concentration of 25.0% by mass.

Preparation of Resin Particle-Dispersed Solution 3

In a beaker equipped with a stirrer, 100.0 parts of ethyl acetate, 30.0 parts of amorphous polyester A1, 0.3 part of 0.1 mol/L sodium hydroxide, and 0.2 part of anionic surfactant (NEOGEN RK, manufactured by DKS Co., Ltd.) were loaded, heated to 60.0° C., and stirred until complete dissolution to prepare a resin solution.

While further stirring the resin solution, 120.0 parts of ion exchanged water was gradually added, phase-inversion emulsification was performed, and the solvent was removed to obtain a resin particle-dispersed solution 3 (solid fraction concentration: 20.0% by mass). The volume average particle diameter of resin particles in the resin particle-dispersed solution 3 was 0.18 μm.

Preparation of Wax-Dispersed Solution 1

| | |
|---|---|
| Paraffin wax (HNP-9, manufactured by Nippon Seiro Co., Ltd.) | 50.0 parts |
| Anionic surfactant (NEOGEN RK, manufactured by DKS Co., Ltd.) | 0.3 parts |
| Ion exchanged water | 150.0 parts |

The above materials were mixed, heated to 95° C., and dispersed using a homogenizer (ULTRA TURRAX T50, manufactured by IKA Works, Inc.). Then, dispersion treatment was performed with a Manton-Gaulin high-pressure homogenizer (manufactured by Gaulin Co.) to prepare a wax-dispersed solution 1 (solid fraction concentration: 25.0% by mass) in which wax particles were dispersed. The volume average particle diameter of the wax particles was 0.20 μm.

Production Example of Magnetic Bodies C3

Magnetic bodies C3 were produced in the same manner as in Production Example of Magnetic Bodies C1 except that no silane coupling agent was added.

Preparation of Magnetic Body-Dispersed Solution 1

| | |
|---|---|
| Magnetic bodies C3 | 25.0 parts |
| Ion exchanged water | 75.0 parts |

The above materials were mixed and dispersed for 10 min at 8000 rpm using a homogenizer (ULTRA TURRAX T50, manufactured by IKA Works, Inc.). After the dispersion, the volume average particle diameter was confirmed to be 0.22 μm.

Production Example of Toner Particles 13

Pre-Aggregation Step

| | |
|---|---|
| Magnetic body-dispersed solution 1 (solid fraction 25.0% by mass) | 105.0 parts |
| Resin particle-dispersed solution 1 (solid fraction 25.0% by mass) | 140.0 parts |
| Wax-dispersed solution 1 (solid fraction 25.0% by mass) | 15.0 parts |

The above materials were loaded in a beaker, and the temperature was adjusted to 30.0° C., followed by stirring at 5000 rpm for 1 min using a homogenizer (ULTRA TURRAX T50, manufactured by IKA Works, Inc.), and then 1.0 part of 2.0% aqueous solution of magnesium sulfate was gradually added as a flocculant followed by stirring for 1 min.

Aggregation Step

| | |
|---|---|
| Resin particle-dispersed solution 2 (solid fraction: 25.0% by mass) | 5.0 parts |
| Resin particle-dispersed solution 3 (solid fraction 20.0% by mass) | 5.0 parts |

The above materials were added to the beaker and the adjustment was made such that the total number of parts of water was 250 parts, followed by stirring at 5000 rpm for 1 min. Further, 9.0 parts of a 2.0% by mass aqueous solution of magnesium sulfate was gradually added as a flocculant.

The raw material dispersion liquid was transferred to a polymerization kettle equipped with a stirrer and a thermometer, and the growth of aggregated particles was promoted by heating to 50.0° C. with a mantle heater and stirring.

When 59 min had elapsed, 200.0 parts of a 5.0% by mass aqueous solution of ethylenediaminetetraacetic acid (EDTA) was added to prepare an aggregated particle-dispersed solution.

Subsequently, the pH of the aggregated particle-dispersed solution was adjusted to 8.0 by using a 0.1 mol/L sodium hydroxide aqueous solution, and the solution was then heated to 80.0° C. and allowed to stand for 3 h to coalesce the aggregated particles.

After 3 h, a particle-dispersed solution in which resin particles were dispersed was obtained.

Then, after cooling at a temperature decrease rate of 1.0° C./min, the resin particle-dispersed solution was filtered and washed with ion exchanged water, and when the conductivity of the filtrate became 50 mS or less, the cake-shaped toner particles were removed.

Next, the cake-shaped toner particles were loaded in ion exchange water taken in an amount 20 times the mass of the toner particles and stirred by a three-one motor. When the toner particles were sufficiently loosened, re-filtration, washing with flowing water, and solid-liquid separation were performed.

The resulting cake-shaped toner particles were pulverized in a sample mill and dried in an oven at 40° C. for 24 h. Further, the obtained powder was pulverized with a sample mill, and additional vacuum drying was performed in an oven at 40° C. for 5 h to obtain toner particles 13.

TABLE 2

| | Crosslinking agent | | Amorphous polyester | | Colorant | |
|---|---|---|---|---|---|---|
| Toner particle No. | Type | Parts by mass | Type | Parts by mass | Type | Parts by mass |
| 1 | L1 | 1.5 | A1 | 5.0 | C1 | 70.0 |
| 2 | L1 | 1.5 | A1 | 17.0 | C1 | 70.0 |
| 3 | L1 | 0.5 | A1 | 5.0 | C1 | 70.0 |
| 4 | L1 | 0.5 | A1 | 10.0 | C1 | 70.0 |
| 5 | L2 | 0.5 | A1 | 5.0 | C1 | 70.0 |
| 6 | L1 | 1.0 | A1 | 5.0 | C1 | 70.0 |
| 7 | L3 | 1.5 | A1 | 5.0 | C1 | 70.0 |
| 8 | L2 | 1.5 | A1 | 5.0 | C1 | 70.0 |
| 9 | L4 | 1.5 | A1 | 5.0 | C1 | 70.0 |
| 10 | L1 | 1.5 | A2 | 5.0 | C1 | 70.0 |
| 11 | L1 | 1.5 | A1 | 5.0 | C2 | 70.0 |
| 12 | L2 | 1.5 | A1 | 10.0 | C1 | 70.0 |
| 13 | Described in the description | | | | | |
| 14 | L1 | 1.0 | A1 | 17.0 | C1 | 70.0 |
| 15 | L1 | 0.1 | A1 | 5.0 | C1 | 70.0 |

Production Example of Toners 2 to 15

Toners 2 to 15 were obtained in the same manner as in Production Example of Toner 1 except that the toner particles 1 were replaced with the toner particles 2 to 15, respectively. Physical properties of the obtained toners 2 to 15 are shown in Table 3.

The toners 2 to 15 were evaluated using the same method as in Example 1. The results are shown in Table 4.

TABLE 3

| | | | TOF-SIMS | | | | | Toner hardness |
|---|---|---|---|---|---|---|---|---|
| | Toner No. | D4 (μm) | A (ppm) | B (ppm) | C (ppm) | D (ppm) | C/(A + B) | C (N/m) |
| Example 1 | 1 | 7.6 | 2800 | 0 | 300 | 100 | 0.11 | 824.0 |
| Example 2 | 2 | 7.5 | 2700 | 0 | 2500 | 100 | 0.93 | 852.1 |
| Example 3 | 3 | 7.9 | 2000 | 0 | 300 | 100 | 0.15 | 833.4 |
| Example 4 | 4 | 7.9 | 2100 | 0 | 2000 | 100 | 0.95 | 842.0 |
| Example 5 | 5 | 7.4 | 2100 | 0 | 1900 | 100 | 0.90 | 849.6 |
| Example 6 | 6 | 7.5 | 2400 | 0 | 1000 | 100 | 0.42 | 830.1 |
| Example 7 | 7 | 7.8 | 2800 | 0 | 300 | 100 | 0.11 | 822.6 |
| Example 8 | 8 | 7.7 | 2800 | 0 | 300 | 100 | 0.11 | 824.0 |
| Example 9 | 9 | 7.3 | 0 | 2800 | 300 | 100 | 0.11 | 820.1 |
| Example 10 | 10 | 7.9 | 2800 | 0 | 50 | 100 | 0.02 | 823.4 |
| Example 11 | 11 | 7.0 | 2800 | 0 | 300 | 5000 | 0.11 | 950.4 |
| Example 12 | 12 | 7.8 | 2100 | 0 | 1900 | 100 | 0.90 | 873.4 |
| Comparative Example 1 | 13 | 7.9 | 1000 | 0 | 2500 | 102 | 2.50 | 860.8 |
| Comparative Example 2 | 14 | 7.2 | 2200 | 0 | 2600 | 103 | 1.18 | 854.2 |

TABLE 3-continued

| | Toner No. | D4 (μm) | TOF-SIMS A (ppm) | B (ppm) | C (ppm) | D (ppm) | C/(A + B) | Toner hardness C (N/m) |
|---|---|---|---|---|---|---|---|---|
| Comparative Example 3 | 15 | 7.6 | 500 | 0 | 300 | 104 | 0.60 | 837.6 |

TABLE 4

| | Toner No. | Evaluation 1 | Evaluation 2 | Evaluation 3 | Evaluation 4 | Evaluation 5 |
|---|---|---|---|---|---|---|
| Example 1 | 1 | A (0.02) | A (0.01) | A (205) | A (2.3) | A |
| Example 2 | 2 | C (0.15) | A (0.08) | B (210) | B (8.7) | A |
| Example 3 | 3 | C (0.13) | A (0.07) | A (205) | B (7.9) | C |
| Example 4 | 4 | C (0.14) | B (0.11) | A (205) | B (9.5) | C |
| Example 5 | 5 | C (0.18) | C (0.20) | B (210) | C (10.8) | C |
| Example 6 | 6 | B (0.08) | A (0.04) | A (205) | A (2.3) | A |
| Example 7 | 7 | A (0.03) | A (0.02) | A (205) | A (2.3) | A |
| Example 8 | 8 | A (0.03) | A (0.01) | A (205) | A (2.3) | B |
| Example 9 | 9 | A (0.04) | B (0.12) | A (205) | C (12.6) | A |
| Example 10 | 10 | A (0.03) | A (0.04) | A (205) | A (2.3) | B |
| Example 11 | 11 | A (0.02) | A (0.04) | A (205) | A (2.3) | C |
| Example 12 | 12 | A (0.03) | A (0.03) | C (220) | A (2.3) | C |
| Comparative Example 1 | 13 | D (0.27) | D (0.25) | D (230) | C (13.4) | D |
| Comparative Example 2 | 14 | D (0.24) | C (0.21) | B (210) | A (2.3) | A |
| Comparative Example 3 | 15 | D (0.22) | C (0.21) | A (205) | A (2.3) | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-230670, filed Dec. 10, 2018, which is hereby incorporated by reference herein in its entirety.

What is claimed is:

1. A toner, comprising:

a toner particle comprising a crystalline material and a binder resin, the binder resin including a vinyl resin having an ether structure, wherein where A (ppm), B (ppm), and C (ppm) are respectively intensities of secondary ion mass/secondary ion charge number(m/z) of 59, 44, and 135 in time-of-flight secondary ion mass spectrometry, C/(A+B)≤1.00 and (A+B)≥2000 when measured 100 nm from a surface of the toner.

2. The toner as in claim 1, wherein the vinyl resin haying an ether structure has a monomer unit derived from a crosslinking agent represented by formula (1)

(1)

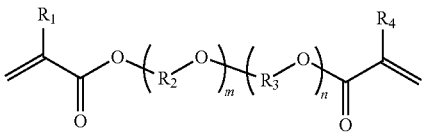

where m+n is an integer of 2 or more, $R_1$ and $R_4$ independently represent H or $CH_3$, and $R_2$ and $R_3$ independently represent a hydrocarbon group having a linear or branched chain having 2 to 12 carbon atoms.

3. The toner as in claim 1, wherein the vinyl resin having an ether structure has a monomer unit derived from a crosslinking agent represented by formula (2)

(2)

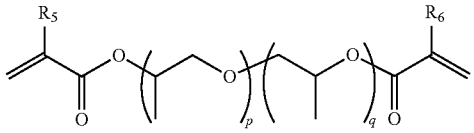

where p+q is an integer of 2 or more, and $R_5$ and $R_6$ independently represent H or $CH_3$.

4. The toner according to claim 1, wherein the toner particle includes an amorphous polyester having a monomer unit represented by formula (3)

(3)

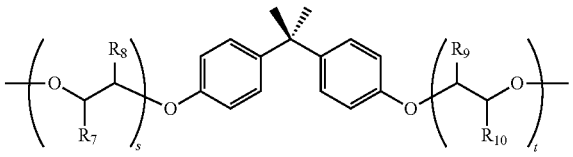

where s+t is an integer of 1 or more, and $R_7$, $R_8$, $R_9$, and $R_{10}$ independently represent H or $CH_3$.

5. The toner according to claim 1, wherein the toner particle includes a magnetic body.

6. The toner according to claim 5, where D (PPM) is an intensity of secondary ion mass/secondary ion charge number (m/z) of 56 in time-of-flight secondary ion mass spectrometry, D≤(A+B) when measured at an outermost surface of the toner.

7. The toner according to claim 1, wherein C is 850.0 or less when a toner hardness (N/m) is plotted against an ordinate, a load application speed (μN/sec) is plotted against an abscissa, and an intercept of a straight line connecting a toner hardness A (N/m) and a toner hardness B (N/m) determined by a nanoindentation method is taken as a toner hardness C (N/m) at a point of time at which the load application speed is 0.00 μN/sec, toner hardness A being an average value of a slope in a displacement region of from 0.00 μm to 0.20 μm in a load-displacement curve obtained by measuring the toner under a condition of a load application speed of 0.83 μN/sec where a load (mN) is plotted against the ordinate, and a displacement amount (μm) is plotted against the abscissa, and toner hardness B being an average value of a slope in a displacement region of from 0.00 μm to 0.20 μm in a load-displacement curve obtained by measuring the toner under a condition of a load application speed of 2.50 μN/sec where a load (mN) is plotted against the ordinate, and a displacement amount (μm) is plotted against the abscissa.

* * * * *